US006120136A

United States Patent [19]

Sugiyama et al.

[11] Patent Number: 6,120,136

[45] Date of Patent: Sep. 19, 2000

[54] LIQUID JET HEAD, A HEAD CARTRIDGE, A LIQUID JET RECORDING APPARATUS, AND A METHOD FOR MANUFACTURING LIQUID JET HEADS

[75] Inventors: Hiroyuki Sugiyama, Sagamihara; Hiroyuki Ishinaga, Tokyo; Toshio Kashino, Chigasaki; Yoichi Taneya, Yokohama, all of Japan

[73] Assignee: Canon Kabushiki Kaisha, Tokyo, Japan

[21] Appl. No.: 09/122,331

[22] Filed: Jul. 24, 1998

[30] Foreign Application Priority Data

Jul. 31, 1997 [JP] Japan ..... 9-206554

[51] Int. Cl.[7] ..... B41J 2/05; B41J 2/14

[52] U.S. Cl. ..... 347/65; 347/48; 347/67

[58] Field of Search ..... 347/48, 65, 67, 347/57, 15, 56, 61

[56] References Cited

U.S. PATENT DOCUMENTS

| | | | |
|---|---|---|---|
| 4,646,110 | 2/1987 | Ikeda et al. | 346/140 R |
| 4,723,129 | 2/1988 | Endo et al. | 346/1.1 |
| 5,097,275 | 3/1992 | Takita | 347/65 |
| 5,606,351 | 2/1997 | Hawkins | 347/15 |
| 5,731,828 | 3/1998 | Ishinaga et al. | 347/62 |
| 5,754,201 | 5/1998 | Ishinaga et al. | 347/62 |

FOREIGN PATENT DOCUMENTS

| | | |
|---|---|---|
| 0 709 195 | 5/1996 | European Pat. Off. . |
| 0 764 531 | 3/1997 | European Pat. Off. . |
| 0 811 489 | 12/1997 | European Pat. Off. . |
| 6-198914 | 7/1994 | Japan . |
| 2 134 041 | 8/1984 | United Kingdom . |

*Primary Examiner*—John Barlow
*Assistant Examiner*—Juanita Stephens
*Attorney, Agent, or Firm*—Fitzpatrick, Cella, Harper & Scinto

[57] ABSTRACT

A liquid jet head is provided with a first bubble generating device for enabling a first flow path conductively connected with a first discharge opening to create a bubble for the formation of discharge droplet, and a second bubble generating device for enabling a second flow path conductively connected with a second discharge opening to create a bubble for the formation of discharge droplet, and comprises a substrate having the first and second bubble generating devices on the surface area shared by them for use, an orifice section provided with the first and second discharge openings sequentially in the direction intersecting the sharable surface area of the substrate, and a flow path formation section for separating each path of the first and second flow paths at least from the discharge opening to the bubble generating device thereof, at the same time, arranging at least part of the first and second flow paths to be essentially in the form of laminated layer with respect to the substrate. With the structure thus arranged, crosstalks are prevented across each line of liquid flow paths, and also, to materialize a liquid jet head capable of making its discharge amount variable for the stabilized discharge of droplets in different amount from the plural lines of discharge openings for recording images in higher precision and quality.

18 Claims, 13 Drawing Sheets

LIQUID JET HEAD, A HEAD CARTRIDGE, A LIQUID JET RECORDING APPARATUS, AND A METHOD FOR MANUFACTURING LIQUID JET HEADS

BACKGROUND OF THE INVENTION

1. Field of the Invention

The present invention relates to a liquid jet head that discharges a desired liquid by the creation of bubbles by the application of thermal energy which acts upon liquid. The invention also relates to a liquid jet recording apparatus that uses such liquid jet head, and a method for manufacturing such liquid jet heads.

Also, the present invention is applicable to a printer, a copying machine, a facsimile equipment provided with communication system, a word processor provided with a printing section, and some other apparatuses, as well as to an industrial recording system having various processing apparatuses combined complexly therefor, thus making it possible to record on paper, thread, fiber, cloth, leather, metal, plastic, glass, wood, ceramic, or some other recording media.

Here, for the present invention, the term "recording" referred to in the specification hereof means not only the provision of characters, graphics, or some other images that express some meaning when recorded on a recording medium, but also, means the provision of images that do not express any particular meaning, such as patterns recorded on a recording medium.

2. Related Background Art

There has been known conventionally an ink jet recording method, that is, the so-called bubble jet recording method, whereby to provide ink with heat or some other energy generated to cause change of states accompanied by the abrupt voluminal changes in ink (the creation of bubbles) so that ink is discharged from discharge openings on the basis of acting force exerted by such change of states, hence forming images on a recording medium by the adhesion of ink to it. The recording apparatus that uses this bubble jet recording method is generally provided with the ink discharge openings for discharging ink; the ink flow paths conductively connected with the discharge openings, and electrothermal transducing devices arranged in the ink flow paths as means for generating energy for discharging ink as disclosed in the specifications of U.S. Pat. No. 4,723,129 and others.

In accordance with a recording method of the kind, it is possible to record high quality images at high speeds in a lesser amount of noises. At the same time, it is possible to arrange the ink discharge openings in high density for the head that adopts this recording method. Therefore, images can be recorded in high resolution by use of a smaller apparatus, while making it easier to obtain color images, among many other advantages. As a result, the bubble jet recording method has been widely used for office equipment, such as a printer, a copying machine, or a facsimile equipment in recent years. Further, an ink jet textile printing apparatus that prints characters, specific patterns and designs on cloth has appeared on the market.

Most of the source documents used for a printer or a copying machine have been those containing monochrome characters, figures, or the like based on the binary data. However, along with the provision of color printers or the like, the graphics and photographs having intermediate gradation as to the density of colors, coloring or the like are used more increasingly for the source documents. The tendency that the printers, copying machines, and the like can appeal the general users good enough only with the capability of color handling at lower costs is now on the verge of shift. In the next stage, the weight is more on the provision of higher quality of images that may contain fine intermediate gradation in them.

The conventional ink jet recording apparatus uses the liquid jet head which is structured by laminating and bonding together a plurality of substrates provided with the heat generating devices (also, referred to as heaters), that is, the electrothermal transducing devices serving as means for creating bubbles, which are arranged in line side by side, and also, with the flow path walls that partition each of the heat generating devices thus arranged. Then, while optimizing the heater sizes, the heater positions, or the opening areas of discharge openings of each line, the heaters on each substrate is selectively controlled to make the amount of ink discharges variable in several steps for the provision of gradation on the recorded images.

However, since the conventional liquid jet head is structured by laminating and bonding a plurality of substrates together, its structure becomes more complicated, which necessitates more precision when manufacturing them, which raises a problem that the costs of manufacture are increased inevitably. Here, the complicated steps required for the manufacture of liquid jet heads tend to result in lowering the precision in which the heads should be produced. Then, there is a problem of production yield which may easily affect the costs of the manufacture, among some others.

SUMMARY OF THE INVENTION

With a view to solving the problems described above, it is an object of the present invention to provide a liquid jet head and a liquid jet recording apparatus, which are compactly structured but arranged to discharge a plurality of liquids stably in accordance with the corresponding conditions of use that may require the variable amount of discharges, gradation recording, and high speed printing, among some others.

It is another object of the invention to provide a method for manufacturing liquid jet heads that makes it easier to manufacture such liquid jet head as described above.

In order to achieve the above objects, the liquid jet head of the present invention, which is provided with a first bubble generating device for enabling a first flow path conductively connected with a first discharge opening to create a bubble for the formation of discharge droplet, and a second bubble generating device for enabling a second flow path conductively connected with a second discharge opening to create a bubble for the formation of discharge droplet, comprises a substrate having the first and second bubble generating devices on the surface area shared by them for use; an orifice section provided with the first and second discharge openings sequentially in the direction intersecting the sharable surface area of the substrate; and a flow path formation section for separating each path of the first and second flow paths at least from the discharge opening to the bubble generating device thereof, at the same time, arranging at least part of the first and second flow paths to be essentially in the form of laminated layer with respect to the substrate. With the structure thus arranged, it becomes possible to prevent crosstalks across each line of liquid flow paths. Further, the flow of liquid in a certain line of liquid flow path produces effect dually on the prevention of heat accumulation of bubble generating means (heat generating device) arranged in each of other liquid flow paths separated from this particular liquid flow path. Consequently, it becomes possible to suppress the temperature rise at the time of high frequency driving. Also, with this arrangement, it is possible to optimize the area and arrangement position of each bubble generating means formed in each of the liquid flow paths, and the area of each discharge opening as well, hence materializing a liquid jet head capable of making its discharge amount variable for the stabilized discharges of droplets from the plural lines of discharge openings in different amount of discharges.

For the liquid jet head described above, it is conceivable that the substrate is provided with a third bubble generating device on the shareable surface area; the orifice section is provided with a third discharge opening together with the first and second discharge openings; and the flow path formation section is provided with a third flow path, and separates the first to third paths of at least from each discharge opening to bubble generating device from each other, and at least a part of the first to third paths is arranged essentially in the form of laminated layer with respect to the substrate or it is conceivable that the substrate is provided with a third bubble generating device on the shareable surface area; the orifice section is provided with a third discharge opening together with the first and second discharge openings; and the flow path formation section is provided with the third flow path, and separates the first to third paths of at least from each discharge opening to bubble generating device from each other, and at the same time, at least a part of the third flow path is adjacent to either one of the first and second flow paths, and is essentially in the form of laminated layer with the other flow path.

Also, it is conceivable for the above liquid jet head that different liquids are used as liquids to be discharged from each of the discharge opening lines, respectively. In this case, it may be possible to adopt for the different liquids those having the same color but different colorant densities or those liquids having different colors, respectively.

Also, for the liquid jet head described above, it is conceivable that the head is provided with a plurality of sets each having the first discharge opening, the first flow path, the first bubble generating device, and a plurality of sets each having the second discharge opening, the second flow path, the second bubble generating device, and the orifice section is provided with the plural first discharge openings and the plural second openings in line and in the state of being separated, respectively, and at the same time, the flow path formation section is provided with the plural first flow paths and the plural second flow paths, while at least part of the plural first and second flow paths being arranged essentially in the form of laminated layer with respect to the substrate, and in the state of being separated from each other.

Further, the liquid flow path formation section forms a first common liquid chamber for supplying the first common liquid to the plural first flow paths, and a second common liquid chamber for supplying the second common liquid to the plural second flow paths.

It is also conceivable that the first bubble generating device and the second bubble generating device are different in distance between the orifice section and each of them, respectively.

In this case, the first bubble generating device is farther away from the orifice section than the second bubble generating device, and the first and second bubble generating devices are positioned on a straight line, and the second liquid path is formed along the surface area of the substrate and provided with a bypass detouring around the first bubble generating device.

Also, the present invention includes a head cartridge provided with a liquid jet head of the kind described above, and a liquid container retaining liquid to be supplied to such liquid jet head.

Also, for the present invention, a liquid jet recording apparatus is arranged to perform recording by relatively moving a liquid jet head and a recording medium. This liquid jet head, which is provided with a first bubble generating device for enabling a first flow path conductively connected with a first discharge opening to create a bubble for the formation of discharge droplet, and a second bubble generating device for enabling a second flow path conductively connected with a second discharge opening to create a bubble for the formation of discharge droplet, comprises a substrate having the first and second bubble generating devices on the surface area shared by them for use; an orifice section provided with the first and second discharge openings sequentially in the direction intersecting the sharable surface area of the substrate; and a flow path formation section for separating each path of the first and second flow paths at least from the discharge opening to the bubble generating device thereof, at the same time, arranging at least part of the first and second flow paths to be essentially in the form of laminated layer with respect to the substrate.

For the above liquid jet recording apparatus, it is conceivable that the head is provided with a plurality of sets each having the first discharge opening, the first flow path, the first bubble generating device, and a plurality of sets each having the second discharge opening, the second flow path, the second bubble generating device, and the orifice section is provided with the plural first discharge openings and the plural second openings in line and in the state of being separated, respectively, and at the same time, the flow path formation section is provided with the plural first flow paths and the plural second flow paths, while at least part of the plural first and second flow paths being arranged essentially in the form of laminated layer with respect to the substrate, and in the state of being separated from each other.

Further, it is conceivable that the liquid flow path formation section forms a first common liquid chamber for supplying the first common liquid to the plural first flow paths, and a second common liquid chamber for supplying the second common liquid to the plural second flow paths.

For the above liquid jet recording apparatus, it is conceivable that the first bubble generating device and the second bubble generating device are different in distance between the orifice section and each of them, respectively.

In this case, it is preferable that the first bubble generating device is farther away from the orifice section than the second bubble generating device, and the first and second bubble generating devices are positioned on a straight line, and the second liquid path is formed along the surface area of the substrate and provided with a bypass detouring around the first bubble generating device. Also, it is preferable that the area of the first discharge opening is larger than the area of the second discharge opening. With the structure thus arranged, it becomes possible to discharge liquids, while changing the discharge amounts of each line of discharge openings.

Further, in accordance with the present invention, a method for manufacturing liquid jet heads is arranged to include a grooved member provided with a plurality of recessed grooves becoming one lateral line of liquid flow paths, and a wall portion having plural lines of discharge openings; a substrate having plural lines of bubble generating devices arranged laterally on one surface, being arranged substantially at right angles to the wall portion; a plurality of separation plates each provided with an aperture in a position corresponding to each of the bubble generating means in lines except those on the line closest to the discharge openings, and separating the lines of discharge openings per line, respectively, and separation walls surrounding each of bubble generating means with the exception of those on the lines closest to the discharge openings, and each of the liquid flow paths being separated to be independent so as to arrange each one of bubble generating devices on the substrate to be in each of the liquid flow paths conductively connected with the plural lines of discharge openings. This method comprises the steps of forming the separation walls on the substrate; and of bonding the separation walls to the separation plates; and then, the step of bonding the grooved member to the substrate provided with the separation walls and the separation plates.

In contrast to the method of manufacture described above, the separation plates and separation walls are formed integrally as one body to provide a separation member. Then, it becomes possible to eliminate the positioning and bonding of the separation plates and the separation walls. In this manner, the production yield of the heads is enhanced, while implementing the cost reduction.

Here, the term "direction of relative movements" used for the specification hereof means the direction in which the carriage moves with respect to a recording medium (hereinafter referred to as the scanning direction) or it means the direction in which a recording medium is being carried with respect to a full line head.

Further, for the present invention, the term "separation member" means a member which is able to completely separate each line of discharge openings and the plural lines of liquid flow paths, and to arrange each one of bubble generating devices in each of the liquid flow paths on one substrate. Therefore, this member is a separation member which includes at least a separation plate that separates each line of liquid flow paths, and separation walls that surround each of the bubble generating means on the substrate so as to enable it to conductively connect with the target liquid flow path.

DETAILED DESCRIPTION OF THE PREFERRED EMBODIMENTS

Hereinafter, with reference to the accompanying drawings, the description will be made of the embodiments in accordance with the present invention.

(First Embodiment)

Figure 1A:
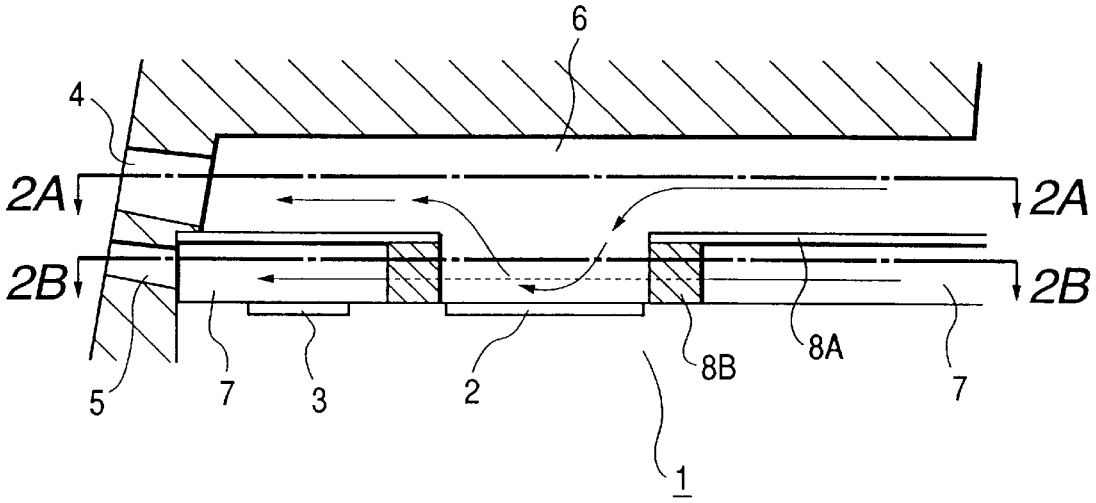
FIG. 1A is a cross-sectional view which shows the characteristic portion of a liquid jet head in accordance with a first embodiment of the present invention, taken in the flow path direction.
Figure 1B:
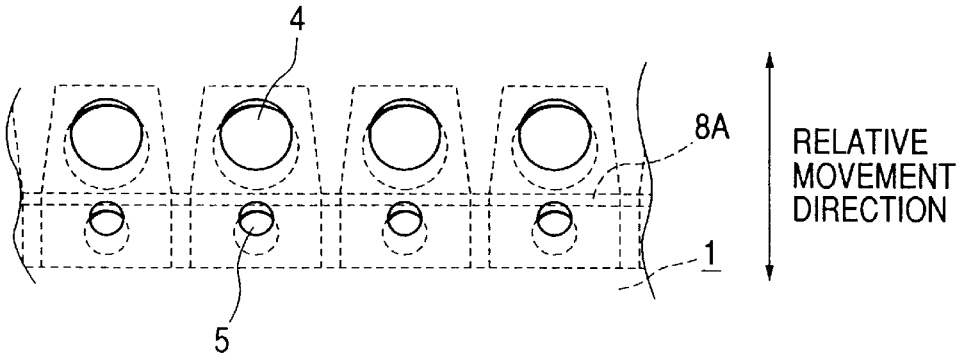
FIG. 1B is a front view which shows one area of the orifice plate of the liquid jet head represented in FIG. 1A.
Figure 2A:
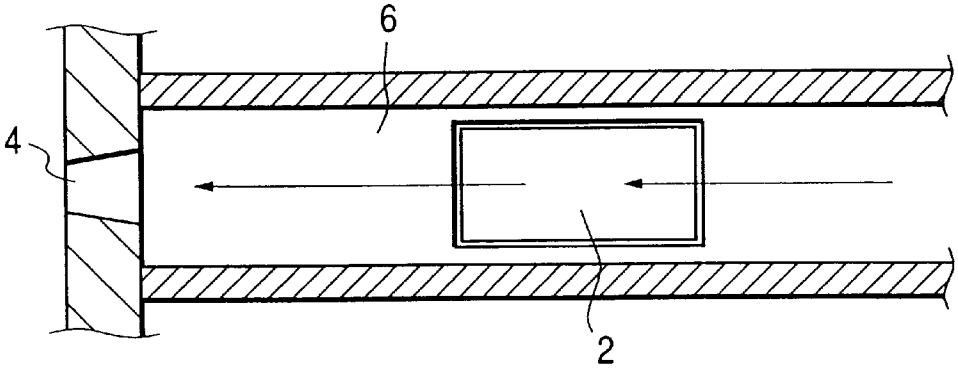
FIG. 2A is a cross-sectional view taken along line 2A—2A in FIG. 1A.
Figure 2B:
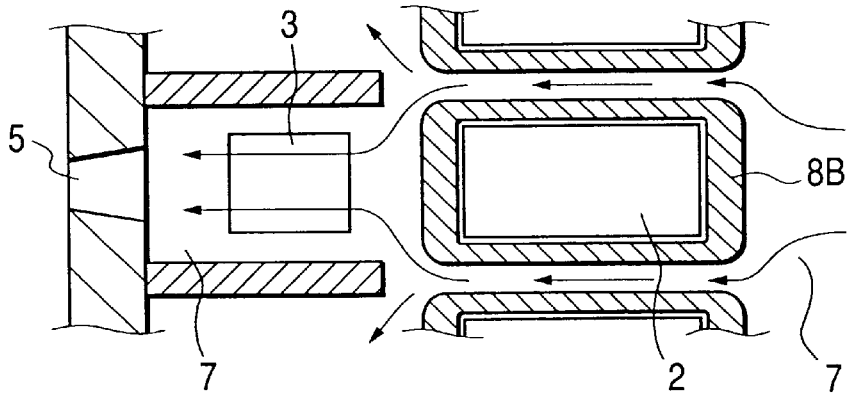
FIG. 2B is a cross-sectional view taken along line 2B—2B in FIG. 1A.
Figure 2C:
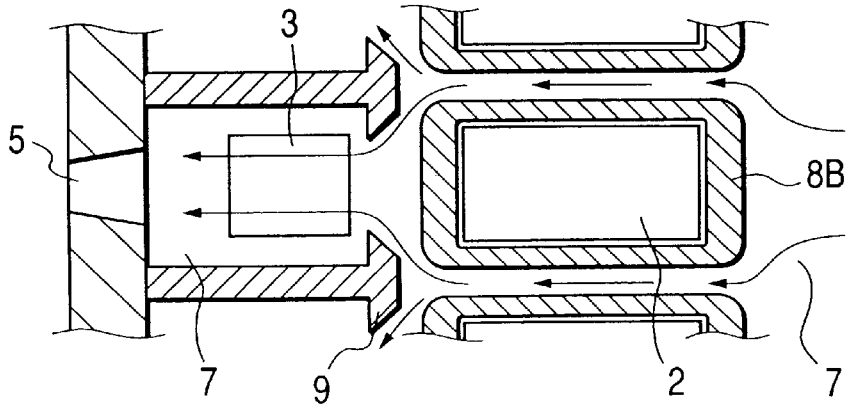
FIG. 2C is a cross-sectional view which shows the variational example of the second liquid flow path shown in FIG. 2B.

FIG. 1A is a cross-sectional view which shows the characteristic portion of a liquid jet head in accordance with a first embodiment of the present invention, taken in the flow path direction; FIG. 1B is a front view which shows one area of the orifice plate of the liquid jet head represented in FIG. 1A. FIG. 2A is a cross-sectional view taken along line 2A—2A in FIG. 1A; FIG. 2B is a cross-sectional view taken along line 2B—2B in FIG. 1A; FIG. 2C is a cross-sectional view which shows the variational example of the second liquid flow path shown in FIG. 2B.

For the liquid jet head of the present embodiment, there are provided, as shown in FIG. 1A, a first heat generating device (first bubble generating device) 2, and a second heat generating device (second bubble generating device) 3, which are arranged in the direction of flow path formation. In other words, the first heat generating device 2 and the second heat generating device 3 are arranged on the surface area of the elemental substrate 1 which is made shareable for them to use. There is also provided for the elemental substrate 1, an orifice section having on it a first discharge opening 4 and a second discharge opening 5 arranged one after another in the direction intersecting the sharable surface area of the elemental substrate 1.

Also, on the elemental substrate 1, a second liquid flow path 7 is conductively connected with the second discharge opening 5. On the upper portion of this liquid flow path 7, a second liquid flow path 6 is conductively connected with the second discharge opening 4. Then, a separate plate 8A and separation walls 8B are inclusively arranged between the first liquid flow path 6 and the second flow path 7 in order to arrange only the first heat generating device 2 in the first liquid flow path 6, and only the second heat generating device 3 in the second liquid flow path 7. In other words, the flow path formation section is provided to separate the paths arranged at least from the discharge openings 4 and 5 to the heat generating devices 2 and 3 into the first liquid flow path 6 and the second liquid flow path 7, respectively.

Further, there are arranged for this liquid jet head, plural sets of each having the first discharge opening 4, the first liquid flow path 6, and the first heat generating device 2, and plural set of each having the second discharge opening 5, the second liquid flow path 7 and the second heat generating device 3. Then, the orifice section is provided with a plurality of first discharge openings 4 and a plurality of the second discharge openings 5, which are arranged in line but in the state of being separated from each other. Further, the liquid flow path formation section is provided with a plurality of the first liquid flow paths 6 and a plurality of the second liquid flow paths 7, at least parts of which are in the state of being laminated but separated from each other with respect to the substrate 1.

Also, the distances of the first heat generating device 2 and the second heat generating device 3 to the orifice section are different from each other. In the present mode, the first heat generating device 2 is farther away from the orifice section than the second heat generating device 3. Here, the first heat generating device 2 and the second heat generating device 3 are positioned on the straight line. Furthermore, the second liquid flow path 7 is formed along the surface zone of the substrate 1. Then, this path forms a bypass around the first heat generating device 2 by means of the separation walls 8B.

The arrows in FIG. 1A and FIGS. 2A to 2C indicate the flow of liquid in the first liquid flow path 6 and the second liquid flow path 7, respectively. As shown in FIG. 1A and FIG. 2A, the liquid flow in the first liquid flow path 6 is from the rear side of the first liquid flow path 6 (the side opposite to the first discharge opening 4), and runs on the surface of the first heat generating device 2. Then, lastly, the liquid is discharged from the first discharge opening 4. As shown in FIG. 1A and FIG. 2B, the liquid flow in the second liquid flow path 7 is from the rear side of the second liquid flow path 7, and runs along the side ends of the separation walls 8B that surround the first heat generating device 2. Then, lastly, the liquid is discharged from the second discharge opening 5.

In this way, the first liquid flow path 6 conductively connected with the first discharge opening 4, and the second liquid flow path 7 conductively connected with the second discharge opening 5 are separated by means of the separation plate 8A and the separation walls 8B to be independent from each other. Therefore, any crosstalks between the first liquid flow path 6 and the second liquid flow path 7 can be prevented.

Further, the liquid that flows in the second liquid flow path 7 runs along the side ends of the separation walls 8B to arrive on the surface of the second heat generating device 3, thus making it possible not only to prevent the heat accumulation on the second heat generating device 3, but to dually produce effect on the prevention of heat accumulation on the first heat generating device 2, because heat is taken away by this flow of liquid through the separation walls 8B. As a result, it becomes possible to suppress the temperature rise when driving is made at higher frequencies.

In this manner, the sizes and positions of heaters arranged in each of the liquid flow paths, and the areas of discharge openings can be optimized to make it possible to materialize a liquid jet head capable of changing the discharge amounts of different droplets, and discharged them stably from each of the first discharge openings 4 and second discharge openings 5.

Also, as shown in FIG. 1B, since the first discharge opening 4 and the second discharge opening 5 are arranged in the direction perpendicular to the nozzle lines, that is, in the scanning direction (the direction of relative movements), the nozzles can deal with different discharge amounts, while its arrangement is made in high density. Here, therefore, by controlling the driving timing of the heat generating devices corresponding to the discharge angle between the first discharge opening 4 and the second discharge opening 5 or corresponding to each of the discharge openings, it becomes possible to make the gradational representation only with the dot-size modulation for every one and same pixel. In this manner, an ink jet recording head can be materialized to obtain images in higher quality at higher speeds. Further, provided that the adjacent pixels are formed by each of them with the same discharge amount for each of them, printing is made executable at higher speeds. Also, with the staggered arrangement of discharge openings in which the relative positions of each nozzle arrangement are deviated at half pitches, respectively, it becomes possible to structure a head capable of providing the enhanced resolution of recorded images. In this respect, the term "scanning direction (direction of relative movements)" means the directions in which the carriage moves for printing with respect to a recording medium or the direction in which a recording medium is carried with respect to a full line head.

Also, as shown in FIG. 2C, the end portion 9 on the rear sides of the flow path walls of the second liquid flow path 7 (the side opposite to the discharge opening 5) are configured to make the gap between the flow path walls narrower to increase the flow path resistance in this portion, thus preventing the crosstalks between the adjacent liquid flow paths more effectively in the direction of the nozzle arrangement.

Figure 3:
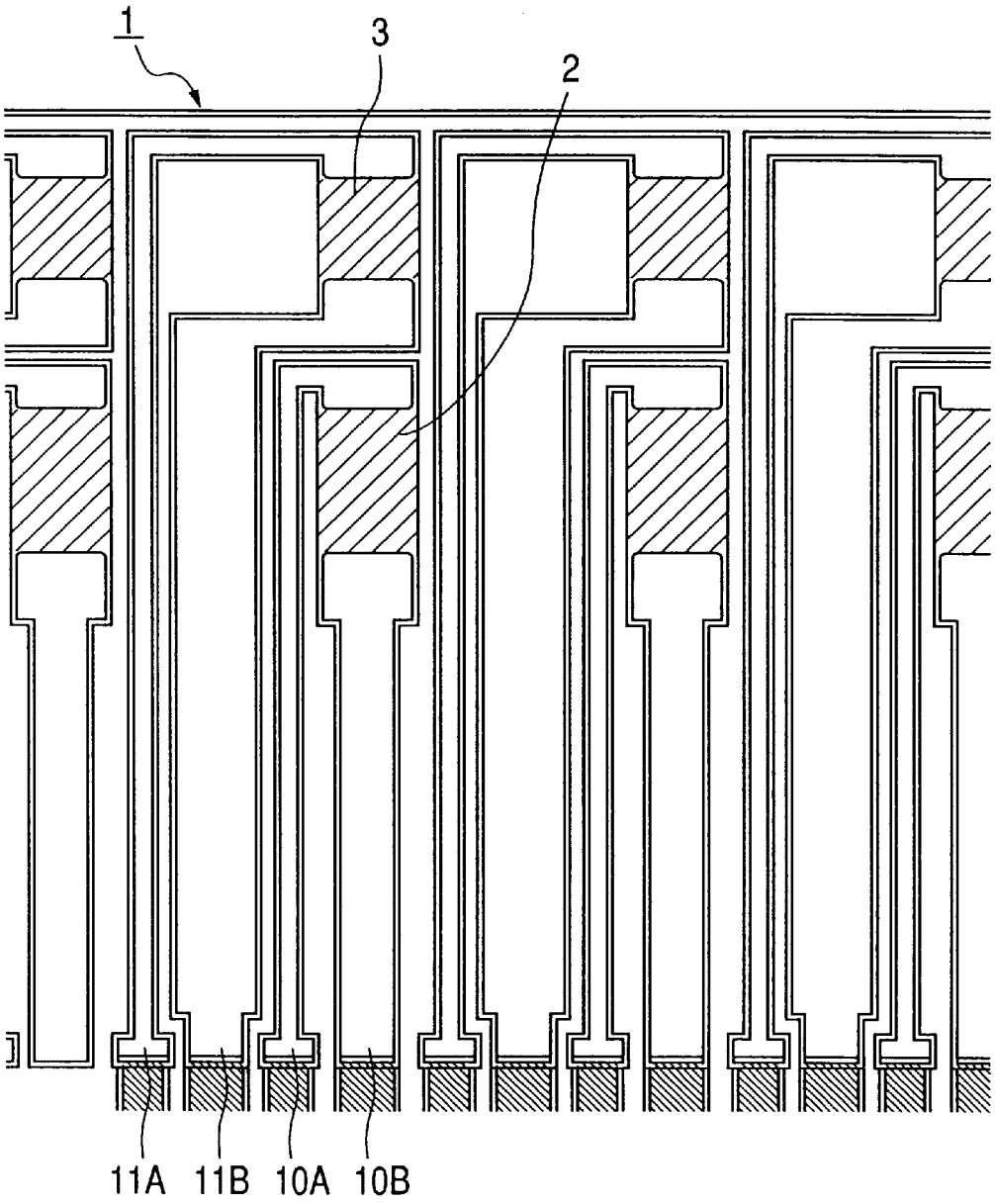
FIG. 3 is a plan view which shows a part of the circumference of the heat generating devices on the elemental substrate represented in FIGS. 1A to 2C.

FIG. 3 is a plan view which shows a part of the circumference of heat generating devices on the elemental substrate 1. FIG. 3 shows schematically the wiring of the first and second heat generating devices and the connecting state thereof as well. In accordance with the structure arranged in this mode, there are arranged on one and the same substrate, the wiring 10A and 10B connected with a plurality of first heat generating devices 2, a plurality of second heat generating devices 3, and each of the first heat generating device 2, and the wiring 11A and 11B connected with each of the plural second heat generating devices 3. In this way, a plurality of first heat generating devices 2 and second heat generating devices 3 are provided for one substrate; in other words, no separate substrate is used individually for each of the first and second heat generating devices 2 and 3. Therefore, the manufacturing processes are made simpler to obtain a good production yield as well as a good resultant cost reduction.

(Second Embodiment)

Figure 4A:
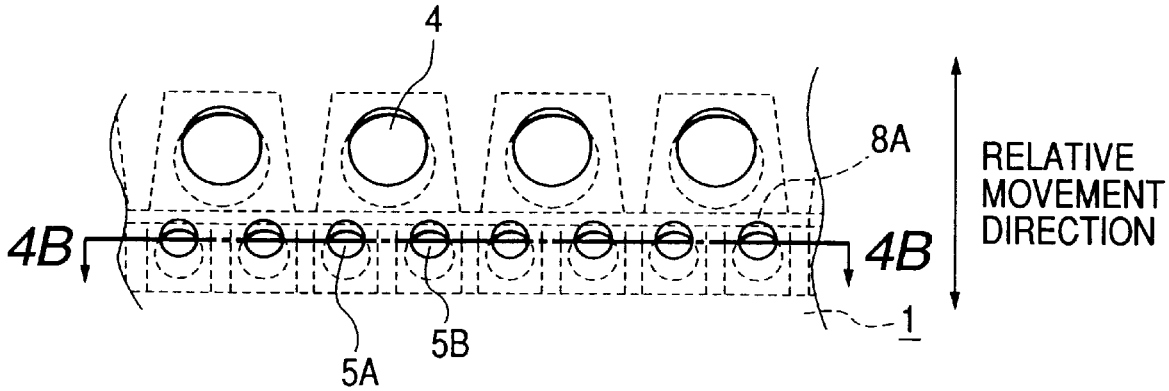
FIG. 4A is a front view which shows the characteristic portion of the liquid jet head in accordance with a second embodiment of the present invention.
Figure 4B:
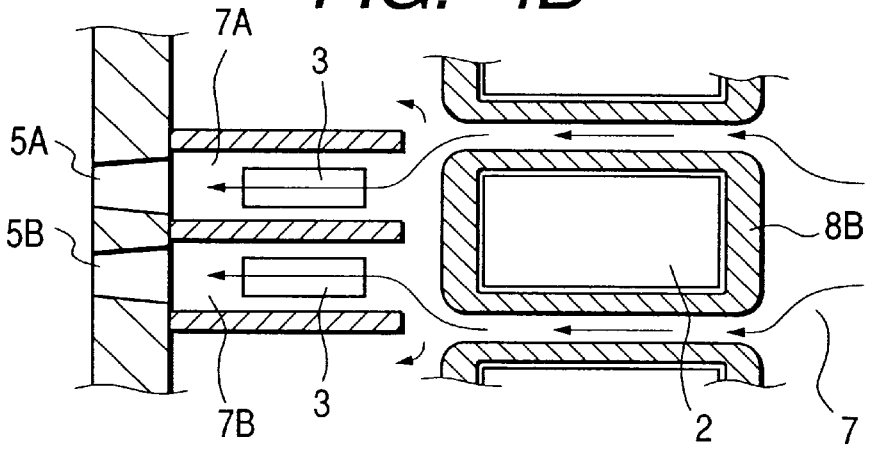
FIG. 4B is a cross-sectional view taken along line 4B—4B in FIG. 4A.
Figure 4C:
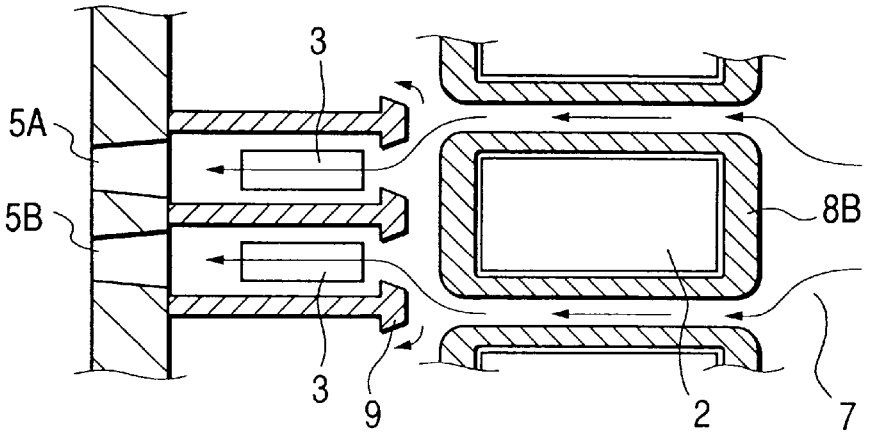
FIG. 4C is a cross-sectional view which shows the variational example of the second liquid flow path represented in FIG. 4B.

FIG. 4A is a front view which shows the characteristic portion of the liquid jet head in accordance with a second embodiment of the present invention; FIG. 4B is a cross-sectional view taken along line 4B—4B in FIG. 4A; FIG. 4C is a cross-sectional view which shows the variational example of the second liquid flow path represented in FIG. 4B. Here, the vertical section of the liquid flow path of the liquid jet head of the present embodiment is the same as FIG. 1A. The cross section of the first liquid flow path is the same as FIG. 2A. The same constituents shown in these vertical- and cross-sectional views as those appearing in the first embodiment are provided with the same reference marks. Hereunder, the description will be made of only those parts which are different from the ones shown in the first embodiment.

What differs in the present embodiment from the first embodiment is that the numbers of the second discharge openings are made double. Therefore, the pitch between the second liquid flow paths 7A and 7B which are conductively connected with the second discharge openings 5A and 5B in FIG. 4A is ½ of the pitch between the first liquid flow paths arranged on the upper part of the second liquid flow paths 7A and 7B.

In order to arrange the structure in this way, the first heat generating device 2 and the second heat generating device 3 for giving thermal energy to liquid for the creation of bubbles should be arranged on the elemental substrate 1 in the direction of the flow path formation as shown in FIGS. 4A to 4C. In this case, when the second heat generating device 3 is arranged in the direction of the flow path formation together with the first heat generating device 2, two pieces of them are arranged in the direction perpendicular to the direction of the liquid path formation. Then, on the elemental substrate 1, the second liquid flow path 7, which is conductively connected with both of the second discharge openings 5A and 5B, is provided, and on the second liquid flow path 7, the first liquid flow path 6, which is conductively connected with the first discharge opening 4, is arranged. The first liquid flow path conductively connected with the first discharge opening 4, and the second liquid flow path 7 conductively connected with the second discharge openings 5A and 5B are separated by the separation plate 8A and separation walls 8B to be independent, respectively. Then, the first heat generating device 2 is arranged in the first liquid flow path, while the second heat generating devices 3 are arranged in the second liquid flow path 7. Here, each of the heat generating devices 3 is partitioned by means of the flow path walls. Thus, one of the heat generating devices is arranged on the second liquid flow path 7A which conductively connected with the second discharge opening 5A directly, while the other one of them is arranged on the second liquid flow path 7B which is conductively connected with the second discharge opening 5B directly.

Further, as shown in FIG. 4C, the rear ends 9 of the separation walls of the second liquid flow paths 7 (the side opposite to the discharging openings 5) are configured to make the width of the flow path walls narrower to enhance the flow path resistance on this portion, hence making it possible to prevent the crosstalks between the adjacent liquid flow paths more effectively in the direction of the nozzle arrangement.

The supply of liquid to the first liquid flow path is carried out as shown in FIG. 1A and FIG. 2A. The supply of liquid to the second liquid flow path is carried out as indicated by arrows shown in FIGS. 4B and 4C.

With the structure thus arranged, the gradation per pixel becomes more than the first embodiment in addition to the same effect obtainable as in the first embodiment. As a result, it is possible to realize the provision of images which are recorded in higher quality.

(Third Embodiment)

Figure 5A:
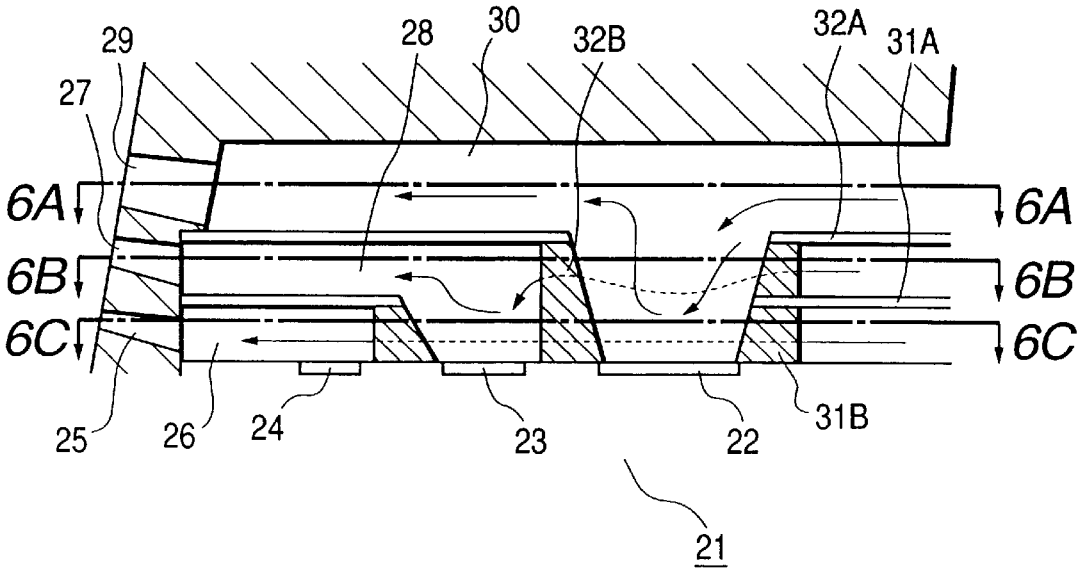
FIG. 5A is a cross-section al view which shows a liquid jet head in accordance with a third embodiment of the present invention, taken in the liquid flow path direction.
Figure 5B:
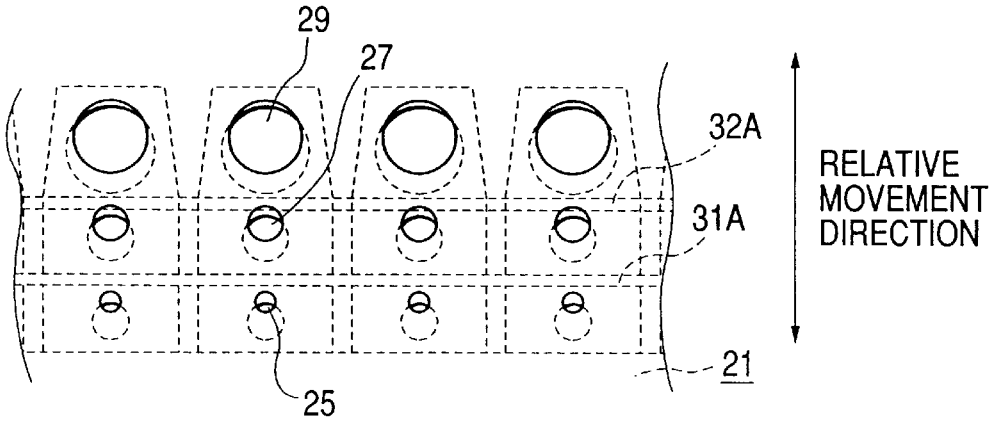
FIG. 5B is a front view which shows one area of the orifice face.
Figure 6A:
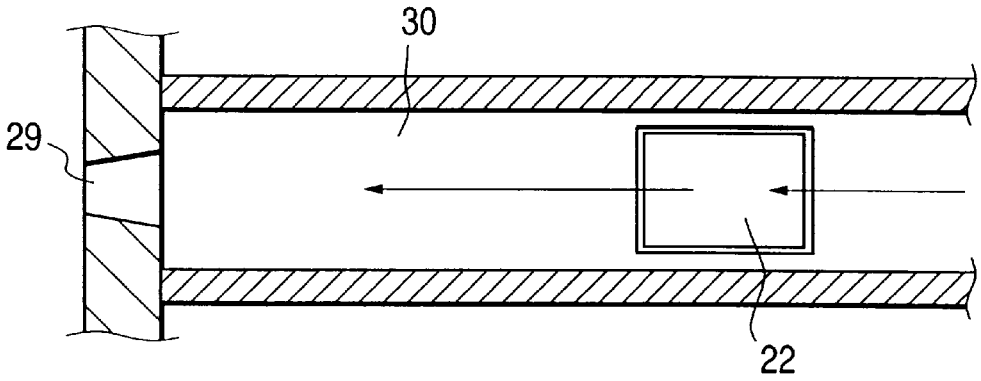
FIG. 6A is a cross-sectional view taken along line 6A—6A in FIG. 5A.
Figure 6B:
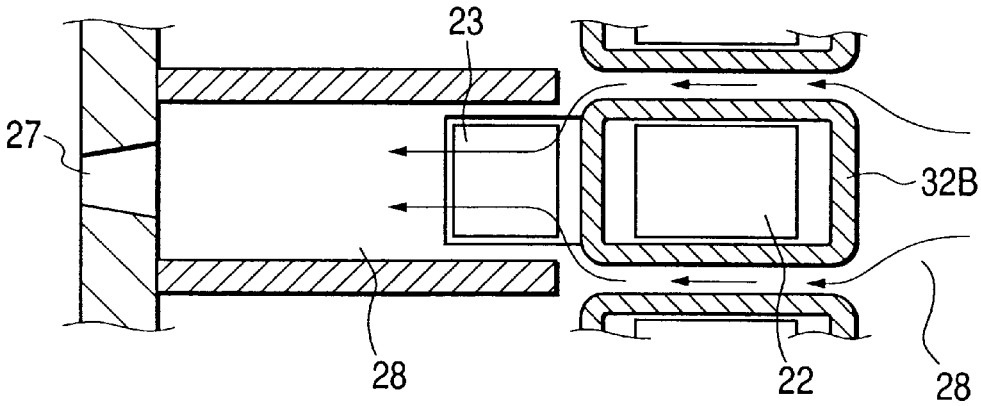
FIG. 6B is a cross-sectional view taken along line 6B—6B in FIG. 5A.
Figure 6C:
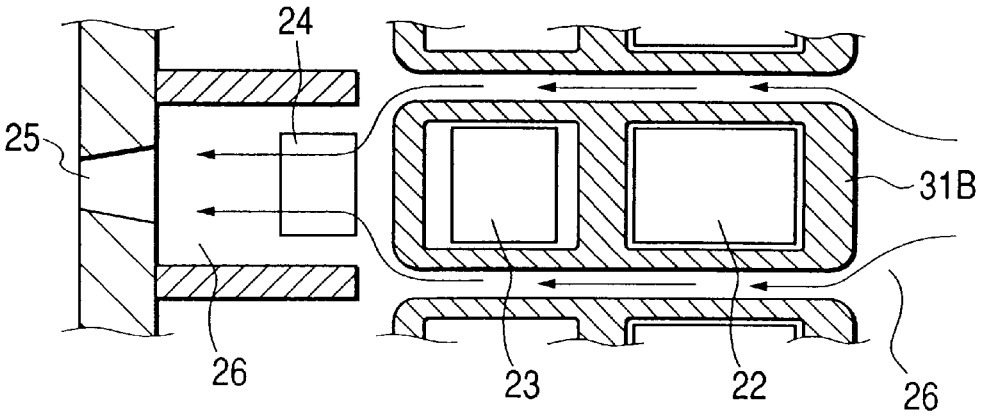
FIG. 6C is a cross-sectional view taken along line 6C—6C in FIG. 5A.

FIG. 5A is a cross-sectional view which shows a liquid jet head in accordance with a third embodiment of the present invention, taken in the liquid flow path direction; FIG. 5B is a front view which shows one area of the orifice face. FIG. 6A is a cross-sectional view taken along line 6A—6A in FIG. 5A; FIG. 6B is a cross-sectional view taken along line 6B—6B in FIG. 5A; FIG. 6C is a cross-sectional view taken along line 6C—6C in FIG. 5A. In these figures, the same reference marks are applied to the same constituents appearing in the above embodiments. Now, hereunder, the description will be made of only the portions that differ from those of the embodiments described above.

In accordance with the present embodiment, three or more (three in FIGS. 5A and 5B) discharge openings are arranged in the direction perpendicular to the direction of the nozzle arrangement. In order to arrange the structure in this way, a first heat generating device 22, a second heat generating device 23, and a third heat generating device 24, which given thermal energy to liquid for the creation of bubbles, should be arranged on the elemental substrate 21 in the direction of the flow path formation as shown in FIG. 5A, for example. On the elemental substrate 21, a third liquid flow path 26, which is conductively connected with a third discharge opening 25, is arranged. On the upper part of the third liquid flow path 26, a second discharge opening 27, which is conductively connected with a second liquid flow path 28 is arranged. Further, a first liquid flow path 30, which is conductively connected with a first discharge opening 29, is arranged. The first liquid flow path 30 and the second liquid flow path 28 are separated by the separation plate 32A and separation walls 32B to be independent from each other. The second liquid flow path 28 and the third liquid flow path 26 are separated by the separation plate 31A and separation walls 31B to be independent from each other. The first heat generating device 22 is arranged in the first liquid flow path 30. The second heat generating device 23 is arranged in the second liquid flow path 28. The third heat generating device 24 is arranged in the third liquid flow path 26.

The arrows shown in FIG. 5A and FIGS. 6A to 6C indicate the flow of liquid in the first liquid flow path 30, second liquid flow path 28, and third liquid flow path 26, respectively. The liquid flow in the first liquid flow path 30 is from the rear side of the first liquid flow path (the side opposite to the first discharge opening 29), and runs on the surface of the first heat generating device 22 as shown in FIG. 5A and FIG. 6A. Then, lastly, it is discharged from the first discharge opening 29. The liquid flow in the second liquid flow path 28 is from the rear side of the first liquid flow path 28 and runs along the side ends of the separation walls 32B that surround the first heat generating device 22 as shown in FIG. 5A and FIG. 6B. Then, lastly, it is discharged from the first discharge opening 27. The liquid flow in the third liquid flow path 26 is from the rear side of the third liquid flow path 26, and runs along the side ends of the separation walls 31B that surround both the first heat generating device 22 and the second heat generating device 23 as shown in FIG. 5A and FIG. 6C. Then, lastly, it is discharged from the first discharge opening 25.

As described above, the liquid jet head of the present embodiment is provided with each of the individual heat generating devices 22, 23, and 24 corresponding to the respective orifices (discharge openings) as in the first and second embodiments. Thus, this liquid jet head can demonstrate the same effect as the first embodiment. Also, by changing the orifice areas per nozzle arrangement (for every arrangement of liquid flow paths each in the upper, middle, and lower stages), it becomes possible to perform a gradational representation having more values per pixel than the second embodiment.

Here, in this mode, too, it is necessary to enable liquid droplets to be impacted on one and the same pixel by controlling the incident angles of each discharge opening and the driving timing of the corresponding heat generating devices with respect to each of the discharge openings as in the first and second embodiments.

(The Other Embodiments)

As set forth above, the principal part of the present invention has been described. Now, hereunder, the description will be made of the other embodiments which are preferably applicable to each of the embodiments described above.

For each of the above embodiments, the description has been made of a liquid jet head capable of executing a multi-valued recording with the discharges of liquid having different discharge amounts from each of the first and second discharge openings. However, it may be possible to implement higher printing with dots of the same size by discharging liquid having one and the same discharge amount from each of the first and second discharge openings.

Also, the present invention makes it possible to execute the method given below using the structure of the above embodiments.

For example, the present invention includes in its scope the recording head and apparatus using the method in which a relatively darker ink is discharged from one of the first and second discharge openings, while a relatively lighter ink from the other discharge opening. In this way, it is possible to realize the gradational representation by utilization of darker and lighter ink by discharging ink having thicker density from one of the first and second discharge openings, while discharging ink having thinner density from the other of them.

Also, the present invention includes in its scope the method whereby to combine discharge droplets from the first and second discharge openings during its flight. Here, there is an advantage that a multi-valued recording can be executed reliably with the combination of discharged liquids. Also, it becomes possible to allow a liquid that reacts upon ink or the like to work on ink before being in contact with a recording medium. In this manner, a desired property of ink is made obtainable only at the time of recording, hence effectuating a significant increase of kinds of liquids that may be used for recording.

Also, the present invention makes it possible to define arbitrarily the relationship between the sizes of the first and second discharge openings; the resistance values of the first and second bubble generating devices; the driving conditions, among some others. This capability is also included in the scope of the present invention.

For any one of the liquid jet heads, the present invention can be utilized suitably if only such head uses a plurality of discharge openings. This versatility is also included in the scope of the present invention. Here, it is of course possible to combine these methods of utilization of the liquid jet head of the present invention as required if there is any for which combination is possible.

(The Entire Structure of the Head)

Now, hereunder, the description will be made of one example of the entire structure of a liquid jet head for which the curtailment of pat numbers can be implemented to make the cost reduction possible. Also, here, the example is given for use of each individual first liquid and second liquid for a liquid jet head provided with individual nozzle arrangement each on the upper and lower stages on one elemental substrate as described in accordance with the first and second embodiments.

Figure 7:
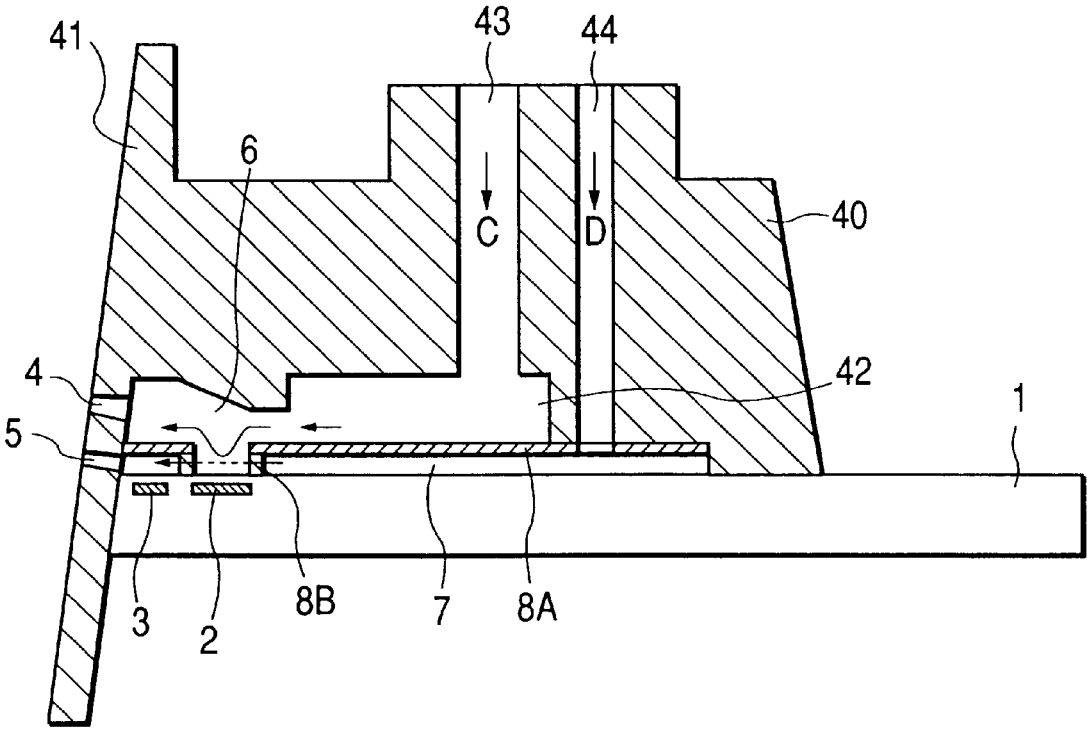
FIG. 7 is a vertically sectional view which shows the entire structure of a liquid jet head in accordance with the first embodiment or the second embodiment of the present invention.

FIG. 7 is a vertically sectional view which shows the entire structure of a liquid jet head of the kind. Here, the same reference marks are applied to the same constituents appearing in the above-mentioned embodiments. The detailed description thereof will be omitted.

In accordance with the embodiment represented in FIG. 7, the grooved member 40 briefly comprises an orifice plate 41 provided with a first discharge opening 4 and a second discharge opening 5 arranged in the direction perpendicular to the elemental substrate 1; a plurality of grooves (not shown) that form a plurality of the first liquid flow paths 6; and a recessed portion that forms the first common liquid chamber 42 conductively connected with and shared by the plural first liquid flow paths 6 in order to supply liquid to each of the first liquid flow paths 6. The elemental substrate 1 is the substrate having on it a plurality of electrothermal transducing devices serving as heat generating devices for generating heat to create film boiling in liquid for the formation of bubbles in it.

On the lower side portion of this grooved member 40, a separation plate 8A is adhesively bonded. In this manner, a plurality of first liquid flow paths 6, which are conductively connected with the first discharge openings 4, are formed. This separation plate 8A is provided with apertures corresponding to the positions of the first heat generating devices 2 on the elemental substrate 1 to which this plate is bonded later. Further, on the lower side portion of the separation plate 8A, the elemental substrate 1 is bonded through the separation walls 8B that surround each of the first heat generating devices 2. In this manner, it is made possible to form each of the second liquid flow paths 7 which is conductively connected only with each of the second discharge openings 5, and which is arranged only with each second heat generating device 3 in the state of being completely separated from each of the first liquid flow paths 6.

The grooved member 40 thus arranged is provided with a first liquid supply path 43 that reaches the interior of the first common liquid chamber 42 from the upper portion of the grooved member 40 for the supply of the first liquid. Also, the grooved member 40 is provided with a second liquid supply path 44 that reaches the interior of the second common liquid chamber 45 from the upper portion of the grooved member 40 through the separation plate 8A.

As indicated by an arrow C in FIG. 7, the first liquid is supplied to the first liquid common chamber 42 through the first liquid supply path 43, and then, supplied to the first liquid flow paths 6. Here, as indicated by an arrow D in FIG. 7, the second liquid is supplied to the second liquid flow path (the second liquid common chamber 7 through the second liquid supply path 44.

The second liquid supply path 44 is arranged in parallel with the first liquid supply path 43, but the arrangement is not necessarily limited to this formation. If only the second liquid supply path (the second common liquid chamber) 7 is formed so that it can be conductively connected with the second common liquid chamber 45, the second liquid supply path may be arranged in anyway for the grooved member 40. Also, the thickness (diameter) of the second liquid supply path 44 is determined in consideration of the amount of supply of the second liquid. It is not necessarily to form this supply path circular, either. Rectangle or the like may be adoptable.

In accordance with the embodiment described above, it becomes possible to reduce the part numbers to make the time required for the manufacturing processes shorter, as well as to reduce the costs of manufacture, because the second liquid supply to supply the second liquid to the second liquid flow paths and the first liquid supply path to supply the first liquid to the first liquid flow paths can be provided by the provision of one and the same grooved member.

Also, the structure is arranged so that the supply of the second liquid to the second liquid flow paths (the second common liquid chamber) is made by the second liquid supply path arranged in the direction which penetrates the separation plate that separates the first liquid and the second liquid. Therefore, bonding of the separation plate, the grooved member, and the elemental substrate is executed in one process at a time, thus making it easier to fabricate them in a better bonding precision, which will contribute to excellent discharges of droplets eventually.

Also, the second liquid is supplied to the second liquid flow paths (the second common liquid chamber) penetrating the separation plate to supply the second liquid to the second liquid flow paths reliably, thus securing a sufficient amount of liquid for the execution of stabilized discharges.

Further, the different liquids used for the first and second liquids in accordance with the above embodiment are in the same color but in the different densities of colorants or in different colors, respectively.

What has been described so far is applicable not only to the head provided with the independent nozzle lines each arranged on the upper and lower stages as has been disclosed herein, but also, applicable to all the heads which are provided with independent nozzle lines each arranged in a plurality of stages in the direction from top to bottom.

Here, also, the example is shown in which different liquids are used as the first and second liquids, but in a case where the same liquid is used, the structure may be arranged so that only one liquid chamber is provided for and shared by the first and second liquid flow paths arranged above and below, and there is only one liquid supply path is needed for this common liquid chamber accordingly.

In this respect, for each of the embodiments of the present invention described above, and for the first liquid flow path among those constituting the entire structure of a head, it may be possible to provide a movable member in a cantilever fashion in which the free end is arranged on the downstream side and the fulcrum is arranged on the upstream side, while positioning the movable member to face the first heat generating member. Here, the terms "upstream" and "downstream" are related to the direction of liquid flowing toward the discharge openings from the supply source of the liquid through the bubble generating area (or the movable member) or related to the structural direction in this respect.

The movable member is formed by metal or some other elastic material, and the one configured like a comb whose free end is released and fulcrum side is integrally formed. The movable member is then prepared simply at lower costs by fixing it to the separation plate 8A. The alignment thereof is also easier with respect to the separation plate 8A.

With the provision of a movable member of the kind, it becomes possible to discharge liquid residing in the vicinity of the first discharge opening more effectively by the synergistic effect of the bubble to be created and the movable member to be displaced by the creation of the bubble.

Also, in order to enhance the characteristics of the first liquid refilling with respect to the bubble generating area of the first heat generating device, slits, small holes, or the like are provided for the movable member (resin or metal in a thickness of several $\mu$m, for instance) to improve its refilling capability.

In these cases described above, it is preferable to arrange the center of the first heat generating device to face the plane section on the upstream side of the free end of the movable member with its efficiency in view.

(The Manufacture of the Liquid Jet Head)

Now, the description will be made of the manufacturing process of a liquid jet head represented in FIG. 7.

Here, briefly, the flow path walls of the second liquid flow path 7 and the separation walls 8B that surround the first heat generating device 2 are formed on the elemental substrate 1. The separation plate 8A having the aperture on the position corresponding to the first heat generating device 2 is installed on the elemental substrate 1 thus arranged. Further on it, the grooved member 40 is installed with grooves and others that form the first liquid flow path 6 or a head is manufactured in such a manner that after the formation of the flow path walls of the second liquid flow path 7 on the elemental substrate 1, a separation member formed integrally with the separation walls 8B and separation plate 8A is installed on the flow path walls, and then, the grooved member 40 is bonded to it.

These manufacture methods will be described further in detail. FIGS. 8A to 8E are cross-sectional views which schematically illustrate the manufacturing processes of a liquid jet head when a separation plate 8A and separation walls 8B are used after each of them is prepared individually. FIGS. 9A to 9D are cross-sectional views which schematically illustrate the manufacturing processes of a liquid jet head using the separation member integrally formed by the separation plate 8A and the separation walls 8B.

Figure 8A:
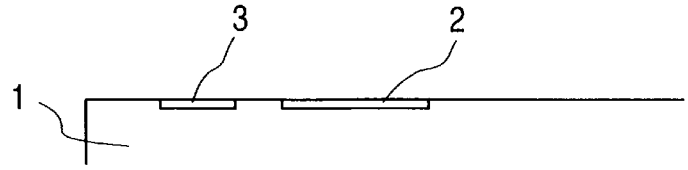
FIGS. 8A, 8B, 8C, 8D and 8E are cross-sectional views which schematically illustrate the head manufacturing processes in a case where the separation plates and the separation walls are formed as individual bodies for a liquid jet head in accordance with another embodiment of the present invention.
Figure 8B:
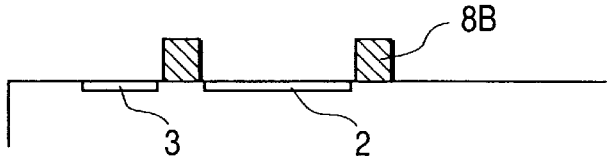
Figure 8C:
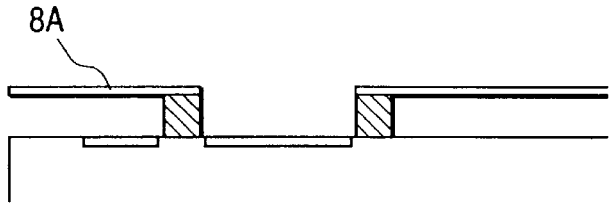
Figure 8D:
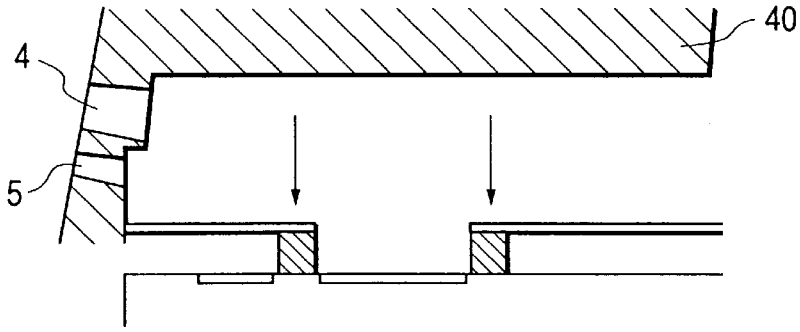
Figure 8E:
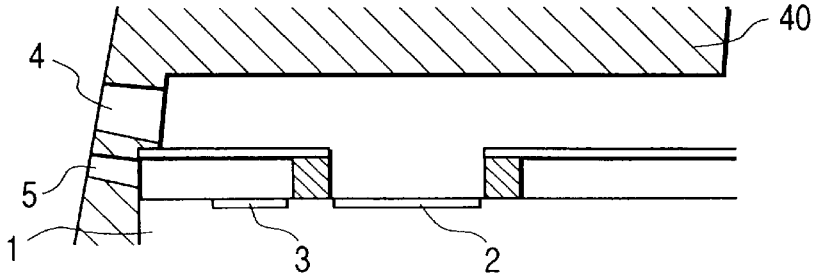
Figure 9A:
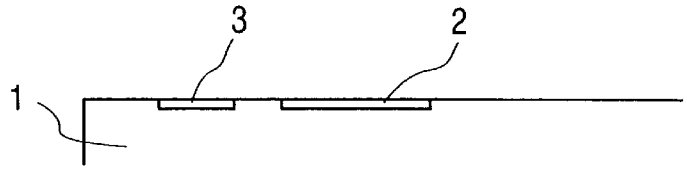
FIGS. 9A, 9B, 9C and 9D are cross-sectional views which schematically illustrate the head manufacturing processes by use of the separation members each having the separation plate and separation walls formed integrally together for a liquid jet head in accordance with another embodiment of the present invention.
Figure 9B:
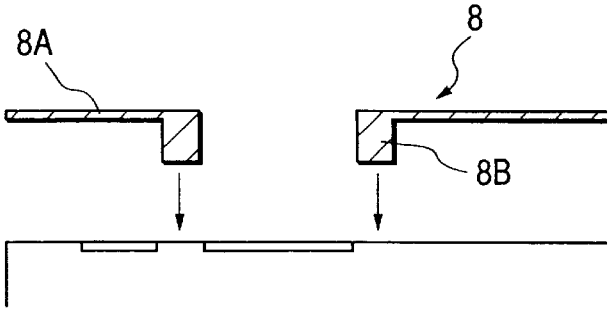
Figure 9C:
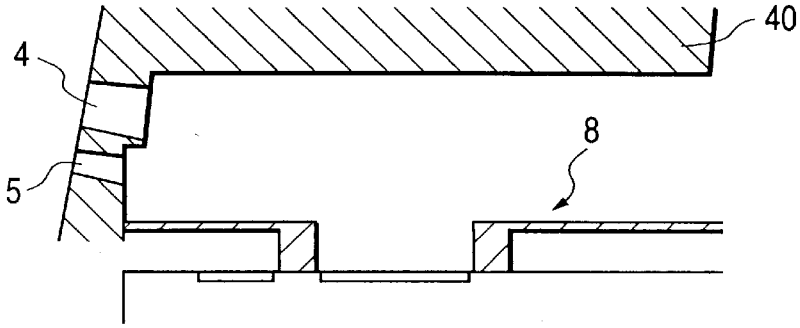
Figure 9D:
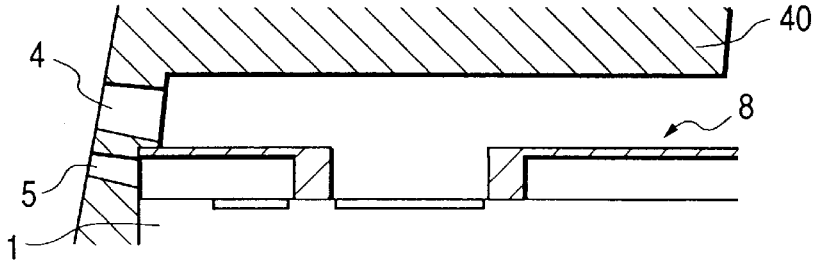

As shown in FIG. 8A, on the elemental substrate having the first heat generating device 2 and the second heat generating device 3 formed on it, the separation walls 8B are formed to surround the first heat generating device 2 as shown in FIG. 8B. After that, as shown in FIG. 8C, the separation plate 8A having a hole, which is open to the portion corresponding to the first heat generating device 2, is positioned, and then, it is bonded on the separation walls 8B. Lastly, the grooved member 40, which is provided with the first discharge opening 4, the second discharge opening 5, and the first liquid flow path walls (not shown) formed on it, is positioned. Then, the grooved member is bonded under pressure to the separation member formed by the separation plate 8A and the separation walls 8B, thus completing the liquid jet head.

In contrast to a method of manufacture of the kind, the one shown in FIGS. 9A to 9D makes it possible to eliminate the positioning and bonding processes of the separation plate 8A and separation walls 8B by using the separation member 8 instead, which is provided with the separation plate 8A and separation walls 8B integrally formed therefor. In this way, it becomes possible to materialize the enhancement of the production yield, and the reduction of costs at the same time.

(The Liquid Jet Head Cartridge)

Now, the description will be made briefly of a liquid jet head cartridge provided with the liquid jet head of the above embodiment which is mounted on it.

Figure 10:
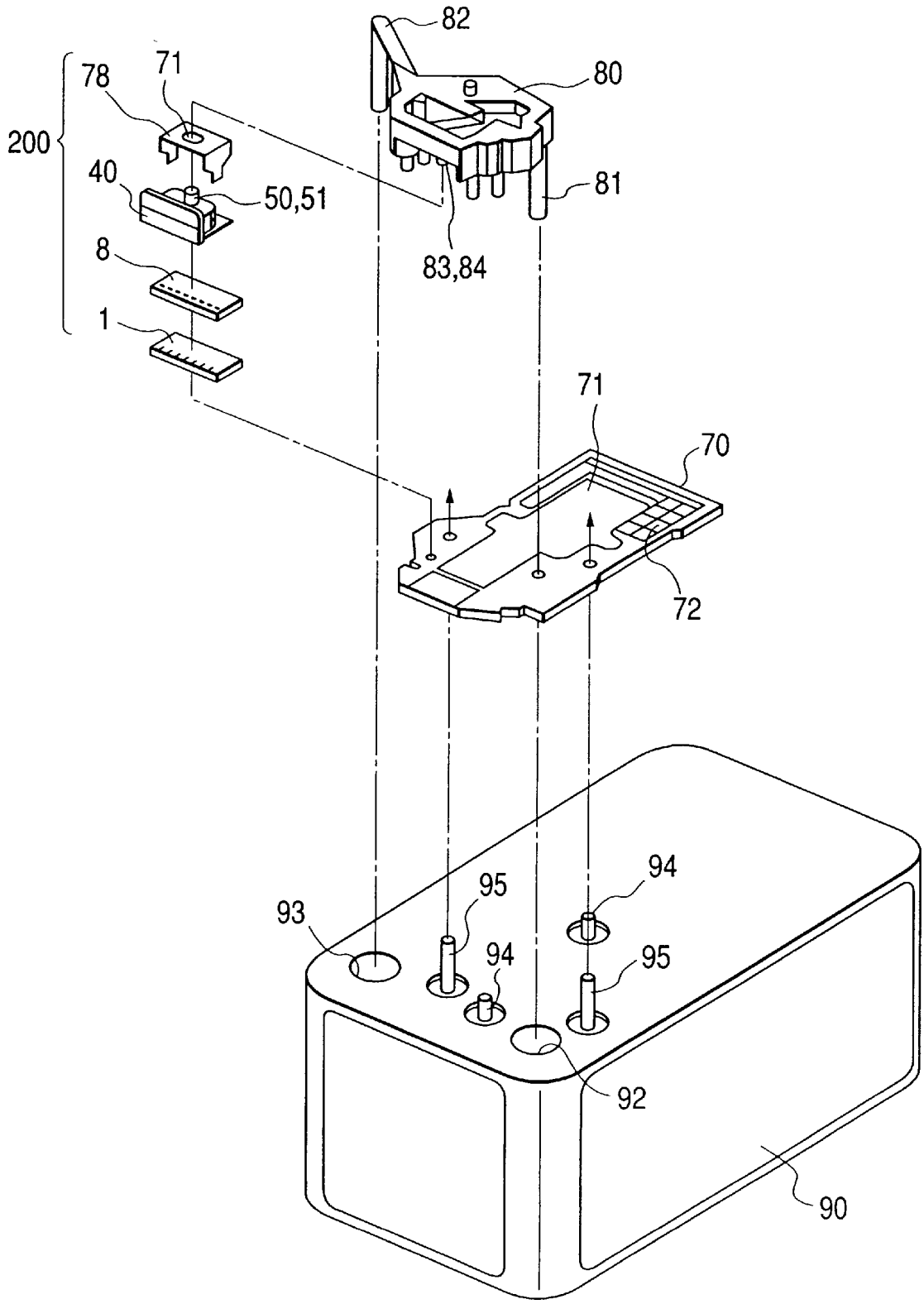
FIG. 10 is an exploded perspective view which schematically shows a liquid jet head cartridge containing the liquid jet head of the present invention.

FIG. 10 is an exploded perspective view which schematically shows the liquid jet head cartridge including the liquid jet head described earlier. This liquid jet head cartridge is mainly formed by a liquid jet head section 200 and a liquid container 80.

The liquid jet head section 200 comprises an elemental substrate 1, a separation member 8, a grooved member 40, a pressure spring 78, a liquid supply member 80, and a supporting member 70, among some others. On the elemental substrate 1, a plurality of heat generating resistors are arranged in line, and also, a plurality of functional devices are arranged in order to drive these heat generating resistors selectively. The second liquid flow path is formed between this elemental substrate 1 and the separation member 8. Then, with the separation member 8 being bonded with the grooved member 40, the first liquid flow path is formed, which is completely separated from the second liquid flow path.

The pressure spring member 78 provides the grooved member 40 with biasing force acting in the direction toward the elemental substrate 1. With this biasing force, the elemental substrate 1, the separation member 8, and the grooved member 40, as well as the supporting member 70 which will be described later, are integrally formed together in good condition.

The supporting member 70 supports the elemental substrate 1 and others. On this supporting member 70, there are further provided a contact pad 72 which is connected with the elemental substrate 1 to exchange electric signals with the printed-circuit board 71 that supplies electric signals, and which is also connected with the apparatus side to exchange electric signals with the apparatus side.

The liquid container 90 retains in it the first liquid and the second liquid separately to supply them to the liquid jet head, respectively. On the outer side of the liquid container 90, the positioning section 94 and the fixing shafts 95 are provided for the arrangement of a connecting member that connects the liquid jet head and the liquid container. The first liquid is supplied to the liquid supply path 81 of the liquid supply member from the liquid supply path 92 of the liquid container through the supply path 84 of the connecting member, and then, supplied to the first common liquid chamber by way of the discharge liquid supply paths 83, 71, and 50 of each of the members. Likewise, the second liquid is supplied to the liquid supply path 82 of the liquid supply member 80 from the supply path 93 of the liquid container through the supply path of the connecting member, and then, supplied to the second common liquid chamber by way of the liquid supply paths 84, 71, and 51 of each of the members.

For the above-mentioned liquid jet head cartridge, the description has been made of the supply mode and the liquid container, which can supply the first liquid and the second liquid are different ones. However, in a case where the first and second liquids are the same, the first and second supply paths and container are not necessarily separated, but are conductively connected through a part of the common liquid chamber of the separation member 8, a part of supply paths, or the like.

Here, for this liquid container, the arrangement may be made to use it by refilling liquids after each of them has been consumed. For that matter, it is preferable to provide an injection inlet of liquid for the liquid container. Also, it may be possible to form the liquid jet head and the liquid container together as one body or form them separately as each individual body.

(The Liquid Discharge Apparatus)

Figure 11:
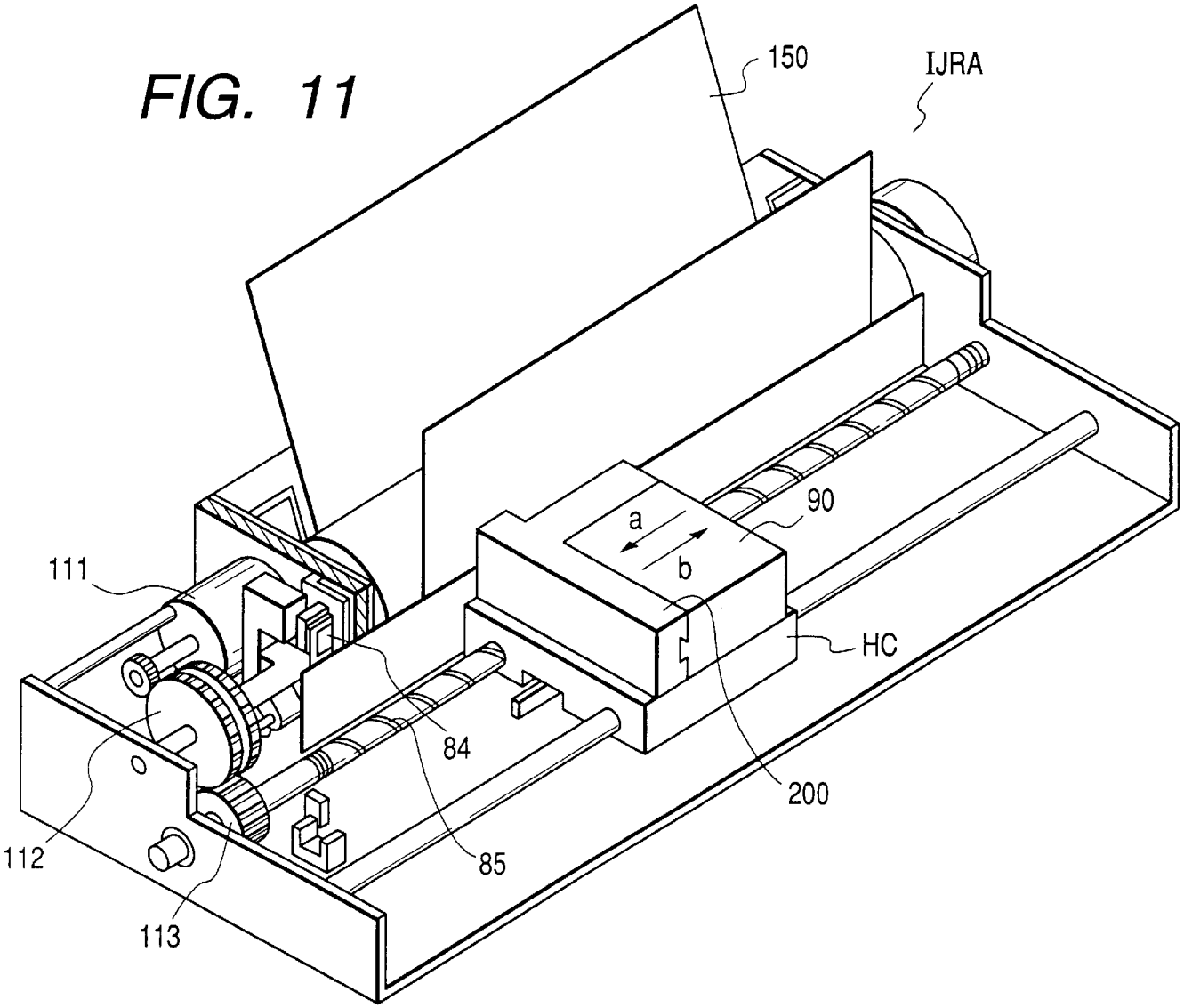
FIG. 11 is a view which schematically shows the structure of a liquid jet recording apparatus having mounted on it the liquid head cartridge containing the liquid jet head of the present invention.

FIG. 11 is a view which schematically shows the structure of a liquid jet apparatus having a liquid jet head mounted on it. Here, in particular, the description will be made of an ink jet recording apparatus that uses ink as discharge liquids.

As shown in FIG. 11, a carriage HC of the liquid jet apparatus mounts on it a detachable head cartridge structured by a liquid tank section 90 that retains ink and a liquid jet head section 200. The carriage reciprocates in the width direction of a recording medium 150, such as a recording paper sheet, which is carried by means for carrying a recording medium. In this case, the arrangement of each line of discharge openings of the liquid jet head 200 is made perpendicular to the direction of carriage movements.

Here, when driving signals are supplied to the liquid jet head section on the carriage HC from driving signal supply means (not shown), recording liquid is discharged from the liquid jet head to the recording medium in accordance with the driving signals.

Also, the liquid jet recording apparatus of the present embodiment is provided with a motor 111 that servers as a driving source, gears 112 and 113, a carriage shaft 115, and others that are needed for transmitting the power from the driving source to the carriage. By use of this recording apparatus and the liquid discharge method adopted therefor, it is possible to obtain images recorded in good condition by discharging liquid to various recording media.

Figure 12:
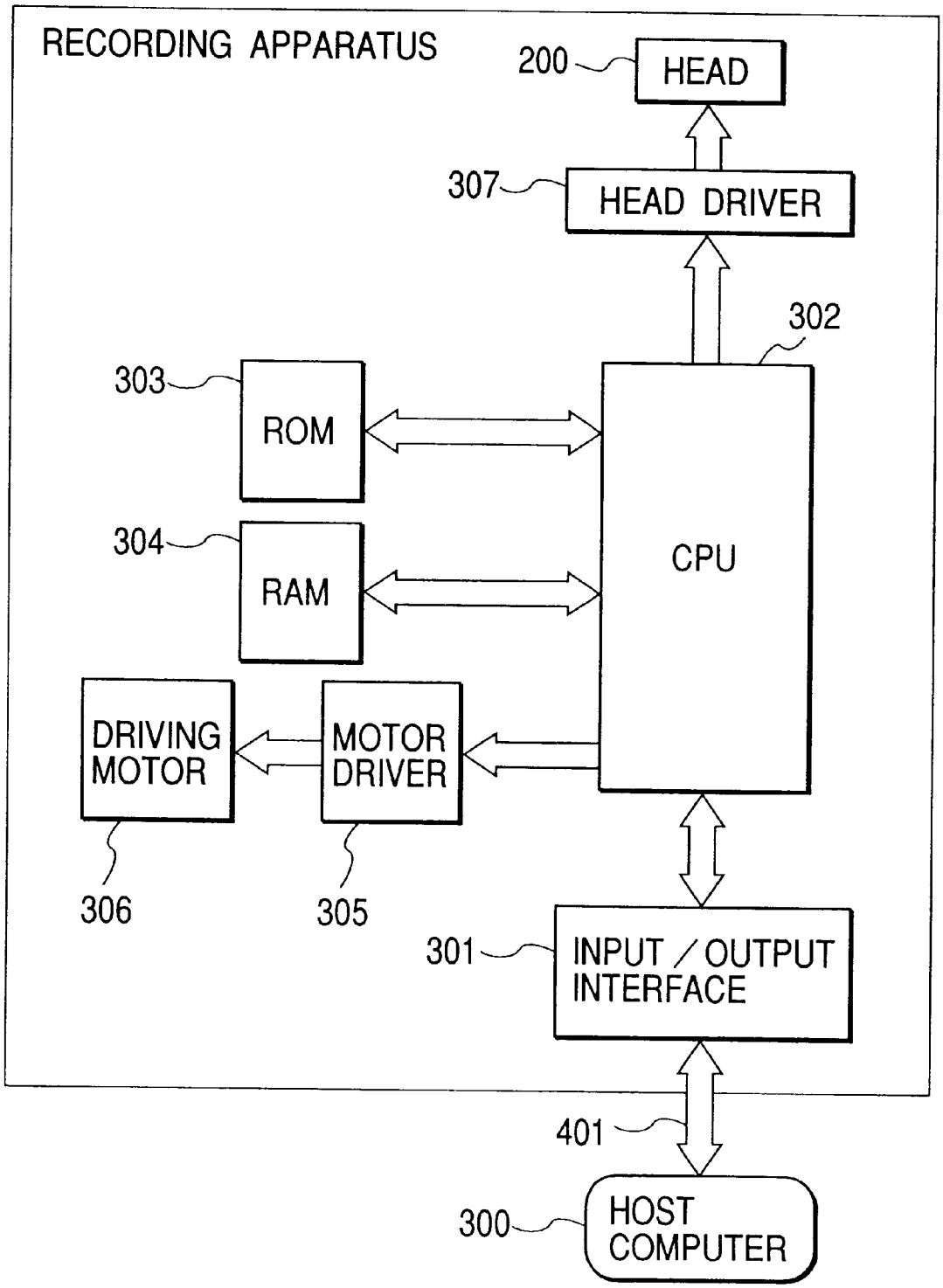
FIG. 12 is a block diagram which shows the entire devices for operating the ink jet recording to which the liquid jet head of the present invention is applicable.

FIG. 12 is a block diagram which shows the entire body of the recording apparatus that performs ink jet recording with the application of the liquid discharge method of the present invention.

In FIG. 12, this recording apparatus receives printing information from a host computer 300 as control signals. The printing information is provisionally held on the input interface 301 arranged in the interior of the recording apparatus. At the same time, the printing information is converted to the data executable by the recording apparatus, and inputted into the CPU 302 which dually serves as means for supplying head driving signals. On the basis of the control program stored on the ROM 303, the CPU 302 processes the data inputted to the CPU 302 using the RAM 304 and other peripheral sections, thus converting them into the data to be printed (image data).

Also, the CPU 302 produces the motor driving data to drive the driving motor to move the recording sheet and the recording head in synchronism with the image data thus produced. The image data and motor driving data are transmitted to the head 200 and the driving motor 306 through the head driver 307 and the motor driver 305, respectively. Then, with the controlled timing, the head and motor are driven so that images are formed.

As the recording media (objects) which are usable by a recording apparatus of the kind for the provision of ink or other liquids thereon, there may be named various kinds of paper and OHP sheets, plastic material usable for compact disc, ornamental board, or the like, textiles, metallic materials such as aluminum, copper, leather material such as cowhide, hog hide, or artificial leather, wood material such as wood or plywood, bamboo material, ceramic material such as tiles, or three-dimensional products such as sponge. Also, the above-mentioned recording apparatuses, there are included a printing apparatus that records on various paper and OHP sheets, a recording apparatus for use of recording on compact discs and other plastic materials, a recording apparatus for use of recording on metal, such as a metallic plate, a recording apparatus for use of recording on leathers, a recording apparatus for use of recording on woods, a recording apparatus for use of recording on ceramics, a recording apparatus for use of recording on a three-dimensional netting structure, such as sponge, and also, textile printing apparatuses that record on textiles.

Also, as the discharge liquid to be used for these liquid jet apparatuses, it should be good enough to adopt the one that matches each of the recording media and recording conditions as well.

(Recording System)

Now, the description will be made of one example of the ink jet recording system whereby to record on a recording medium using the above-mentioned liquid jet head as the recording head.

Figure 13:
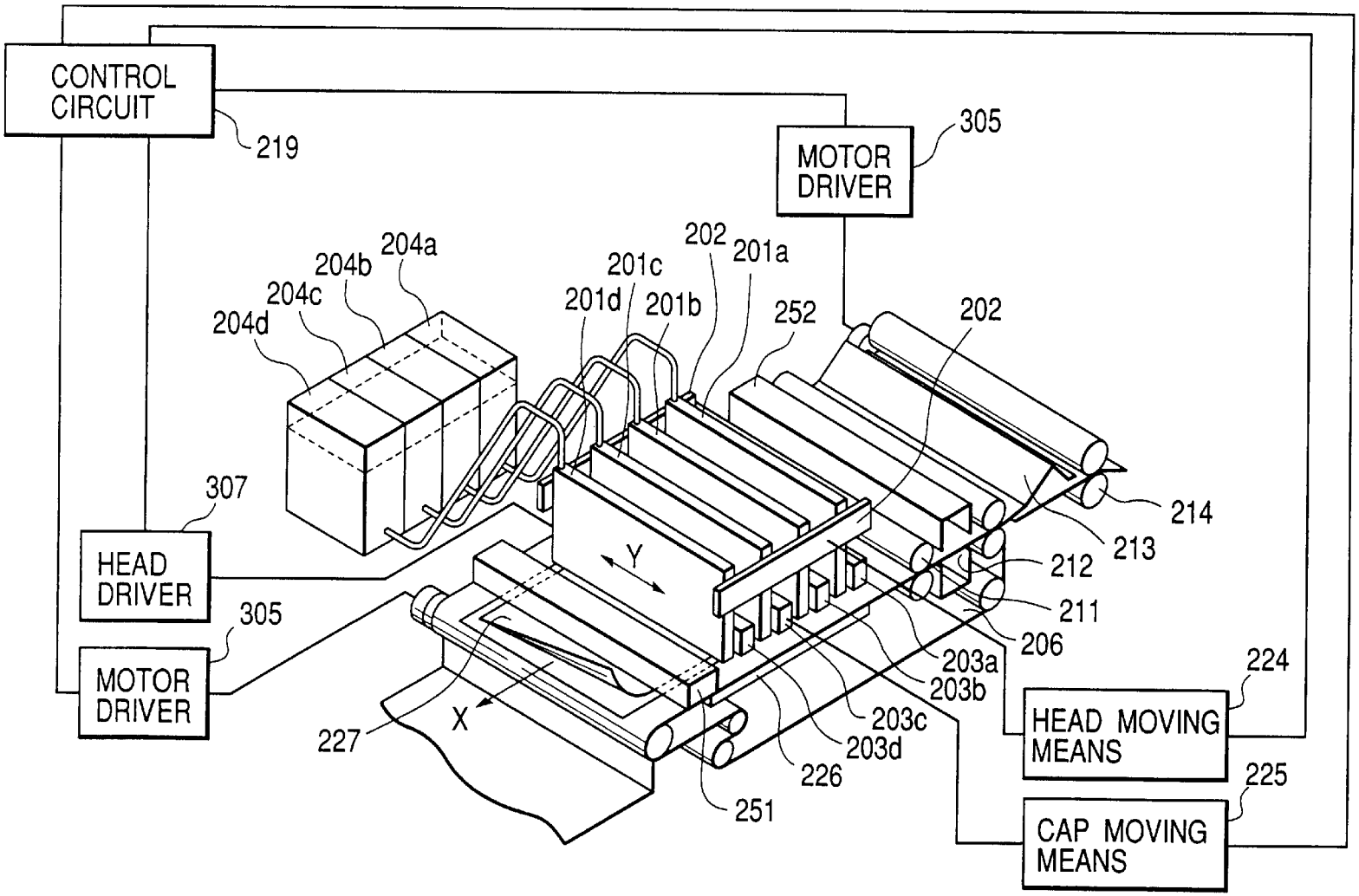
FIG. 13 is a view which schematically illustrates the structure of an ink jet recording system using the liquid jet head of the present invention.

FIG. 13 is a view which schematically illustrates the structure of the ink jet recording system using the liquid jet head 200 of the present invention.

The liquid jet head 200 arranged in the mode as sown in FIG. 13 is a full line type head where a plurality of discharge openings are arranged at intervals of 360 dpi in a length corresponding to the recordable width of the recording medium 150. Four liquid jet heads 201*a*, 201*b*, 201*c*, and 201*d*, each for yellow (Y), magenta (M), cyan (C), and black (Bk) are fixed and supported by a holder 202 in parallel with each other at given intervals in the direction X.

To these liquid jet heads, signals are supplied from the head driver 307. On the basis of such signals, each of the liquid jet heads is driven.

For each of the liquid jet heads, four color ink of Y, M, C and Bk are supplied from each of the ink containers 204*a* to 204*d* as the first liquid.

Also, on the lower part of each of the liquid jet heads, there is arranged each of the head caps 203*a* to 203*d* having in it a sponge or some other ink absorbent, respectively. When recording is at rest, each of the liquid jet heads is covered with each of the head caps 203*a* to 203*d* in order to keep each of them in good condition.

Here, a reference numeral 206 designates a carrier belt which constitutes carrier means for carrying various kinds of recording media as described earlier for each of the embodiments. The carrier belt 206 is drown around a given path by means of various rollers, and driven by driving rollers connected with a motor driver 305.

For this ink jet recording system, a preprocessing apparatus 251 and a postprocessing apparatus 252 are provided on the upstream and downstream sides of the recording medium carrier path in order to give various treatments to the recording medium before and after recording, respectively.

The preprocess and postprocess are different in its contents depending on the kinds of recording media, and also, on the kinds of ink to be used. However, for the recording medium formed by metallic, plastic, or ceramic material, or the like, for example, ultraviolet and ozone irradiation are given as the preprocessing thereof. In this way, the surface of the recording medium is activated to implement the enhancement of ink adhesion. Also, for the plastic recording medium or the like, which tends to generate static electricity, an ionizer is used as a preprocessing device to remove the static electricity generated on the recording medium, because dust particles may easily adhere to the surface thereof, and such adhesion of dust particles may, in turn, hinder the normal performance of recording. Also, when textiles are used as a recording medium, it may be possible to provide textiles with a substance which is selective from among alkaline substance, water soluble substance, synthetic polymer, water soluble metallic salt, and thiourea with a view to enhancing the stain-resistance, the percentage exhaustion, or the like. The preprocessing is not necessarily limited to those mentioned here, but it may be possible to adopt a treatment that gives an appropriate temperature to a recording medium.

On the other hand, the postprocessing is such as to promote the fixation of ink by giving heat treatment, irradiation of ultraviolet rays, or the like to the recording medium on which ink has been provided, or such as to carry out a process to rinse away the processing agent that has adhered to the recording medium in the preprocessing but remains yet to be activated, among some others.

In this respect, the description has been made of the case where a full line head is used for the liquid jet head. However, the liquid jet head is not necessarily limited to the full line type. It may be possible to adopt a smaller liquid jet head described earlier, which is arranged to be in a mode that recording is performed by carrying the head in the width direction of a recording medium.

With the present invention that has been described above, each of the liquid flow paths is separated to be independent by means of the separation member so that each one of the bubble generating devices is arranged in each line of liquid flow paths on one substrate to be conductively connected with plural lines of discharge openings. In this manner, it is made possible to prevent crosstalks across each line of liquid flow paths. Further, the flow of liquid in a certain line of liquid flow path produces effect dually on the prevention of heat accumulation of bubble generating means (heat generating device) arranged in each of other liquid flow paths separated from this particular liquid flow path. Consequently, it becomes possible to suppress the temperature rise at the time of high frequency driving. Also, with this arrangement, it is possible to optimize the area and arrangement position of each bubble generating means formed in each of the liquid flow paths, and the area of each discharge opening as well, hence materializing a liquid jet head capable of making its discharge amount variable for the stabilized discharges of droplets from the plural lines of discharge openings in different amount of discharges.

Also, since the discharge openings to discharge liquid are arranged transversely in plural lines, it is possible to provide nozzles having different discharge amounts, while maintaining its high density.

Also, in accordance with the method for the liquid jet heads of the present invention, it is possible to manufacture such liquid jet heads as described above in good precision with ease, while reducing the number of parts to lower the costs of manufacture.

Also, when adopting the liquid jet head of the present invention as a liquid jet recording head for recording use, it is possible to attain recording images in higher quality.

Also, by use of the liquid jet head of the present invention, it is possible to provide a liquid jet recording apparatus whose liquid discharge efficiency is enhanced, among some other improvements.

What is claimed is:

1. A liquid jet head provided with a first bubble generating device for enabling a first flow path conductively connected with a first discharge opening to create a bubble for formation of a first discharge droplet, and a second bubble generating device for enabling a second flow path conductively connected with a second discharge opening to create a bubble for formation of a second discharge droplet, said head comprising:

a substrate having said first and said second bubble generating devices on a shared surface area;

an orifice section provided with said first and said second discharge openings sequentially in a direction intersecting said shared surface area of said substrate; and a flow path formation section for separating from one another each of the first and the second flow paths, each of the flow paths being separated at least from the discharge opening corresponding thereto to the bubble generating device corresponding thereto, at least part of said first and said second flow paths being arranged so that the first flow path is disposed in a first layer adjacent to said substrate and said second flow oath is disposed in a second layer adjacent to said first layer.

2. A liquid jet head according to claim 1, wherein said head further comprises a plurality of first sets, each said first set having said first discharge opening, said first flow path, and said first bubble generating device, and a plurality of second sets, each said second set having said second discharge opening, said second flow path, and said second bubble generating device, and said orifice section is provided with said plural first discharge openings and said plural second openings in a line and in a separated state, respectively, and said flow path formation section is provided with said plural first flow paths and said plural second flow paths, and at least part of said plural first and said plural second flow paths are arranged in a laminated layer with respect to said substrate, and are separated from one another.

3. A liquid jet head according to claim 2, wherein said liquid flow path formation section forms a first common liquid chamber for supplying a first common liquid to said plural first flow paths, and a second common liquid chamber for supplying a second common liquid to said plural second flow paths.

4. A liquid jet head according to any of claims 1–3, wherein said first bubble generating device and said second bubble generating device are separated by different distances from said orifice section.

5. A liquid jet head according to claim 4, wherein said first bubble generating device is located farther away from said orifice section than said second bubble generating device, and said first and said second bubble generating devices are positioned on a straight line, and said second liquid path is formed along a surface area of said substrate and is provided with a bypass path detouring around said first bubble generating device.

6. A liquid jet head according to claim 5, wherein an area of said first discharge opening is larger than an area of said second discharge opening.

7. A liquid jet head according to claim 1, wherein:

said substrate has a third bubble generating device on said shared surface area;

said orifice section has a third discharge opening; and said flow path formation section has a third flow path, and further separates said third path at least from the third discharge opening to the third bubble generating device, and at least a part of said third path is arranged so that the third flow path is disposed in a third-layer adjacent to said second layer.

8. A liquid jet head according to claim 1, wherein:

said substrate has a third bubble generating device on said shared surface area;

said orifice section has a third discharge opening; and said flow path formation section has a third flow path, and further separates from one another said first to said third paths each from the discharge opening associated therewith to the bubble generating device associated therewith, and at least a part of said third flow path is adjacent to either of said first and said second flow paths, and said first, said second and said third flow paths are arranged in layers.

9. A liquid jet head according to claim 1, wherein a liquid discharged by the first liquid flow paths and a liquid discharged by the second liquid flow paths are different.

10. A liquid jet head according to claim 9, wherein said different liquids are a same color but have different colorant densities.

11. A liquid jet head according to claim 9, wherein said different liquids are different colors.

12. A head cartridge comprising:

a liquid jet head according to any of claims 1–11; and a liquid container for retaining liquid that is supplied to said liquid jet head.

13. A liquid jet recording apparatus for recording by causing relative movement between a liquid jet head and a recording medium, said liquid jet head provided with a first bubble generating device for enabling a first flow path conductively connected with a first discharge opening to create a bubble for formation of a first discharge droplet, and a second bubble generating device for enabling a second flow path conductively connected with a second discharge opening to create a bubble for formation of a second discharge droplet, said apparatus comprising:

a substrate having said first and said second bubble generating devices on a shared surface area;

an orifice section provided with said first and said second discharge openings sequentially in a direction intersecting said shared surface area of said substrate; and a flow path formation section for separating from one another each of the first and the second flow paths, each of the flow paths being separated at least from the discharge opening corresponding thereto to the bubble generating device corresponding thereto, at least part of said first and said second flow paths being arranged so that the first flow path is disposed in a first layer adjacent to said substrate and said second flow path is disposed in a second layer adjacent to said first layer.

14. A liquid jet recording apparatus according to claim 13, wherein said head further comprises a plurality of first sets, each said first set having said first discharge opening, said first flow path, and said first bubble generating device, and a plurality of second sets, each said second set having said second discharge opening, said second flow path, and said second bubble generating device, and said orifice section is provided with said plural first discharge openings and said plural second openings in a line and in a separated state, respectively, and said flow path formation section is provided with said plural first flow paths and said plural second flow paths, and at least part of said plural first and said plural second flow paths are arranged in a laminated layer with respect to said substrate, and are separated from one another.

15. A liquid jet recording apparatus according to claim 14, wherein said liquid flow path formation section forms a first common liquid chamber for supplying a first common liquid to said plural first flow paths, and a second common liquid chamber for supplying a second common liquid to said plural second flow paths.

16. A liquid jet recording apparatus according to any of claims 13–15, wherein said first bubble generating device and said second bubble generating device are separated by different distances from said orifice section.

17. A liquid jet recording apparatus according to claim 16, wherein said first bubble generating device is located farther away from said orifice section than said second bubble generating device, and said first and said second bubble generating devices are positioned on a straight line, and said second liquid path is formed along a surface area of said substrate and is provided with a bypass path detouring around said first bubble generating device.

18. A liquid jet recording apparatus according to claim 17, wherein an area of said first discharge opening is larger than an area of said second discharge opening.

* * * * *

UNITED STATES PATENT AND TRADEMARK OFFICE

CERTIFICATE OF CORRECTION

PATENT NO. : 6,120,136

DATED : September 19, 2000

INVENTOR(S) : HIROYUKI SUGIYAMA ET AL.

It is certified that error appears in the above-identified patent and that said Letters Patent is hereby corrected as shown below:

COLUMN 10

Line 31, "given" should read --gives--.

COLUMN 17

Line 18, "sown" should read --shown--.

COLUMN 19

Line 5, "oath" should read --path--.

Signed and Sealed this

Eighth Day of May, 2001

*Attest:*

Nicholas P. Godici

NICHOLAS P. GODICI

*Attesting Officer*

*Acting Director of the United States Patent and Trademark Office*